United States Patent [19]

Tenconi

[11] Patent Number: 4,730,466

[45] Date of Patent: Mar. 15, 1988

[54] DEVICE FOR SUPPORTING COPS IN CIRCULAR KNITTING MACHINES, PARTICULARLY IN FIXED NEEDLE CYLINDER KNITTING MACHINES

[75] Inventor: Riccardo Tenconi, Varese, Italy

[73] Assignee: MEC-MOR S.p.A., Induno Olona, Italy

[21] Appl. No.: 855,425

[22] Filed: Apr. 24, 1986

[30] Foreign Application Priority Data

May 9, 1985 [IT] Italy ..... 20632 A/85

[51] Int. Cl.[4] ..... D04B 3/06

[52] U.S. Cl. ..... 66/125 R; 242/131; 242/131.1; 66/157

[58] Field of Search ..... 66/125, 157; 242/131, 242/131.1

[56] References Cited

U.S. PATENT DOCUMENTS 3,304,026 2/1967 Bucklow et al. ..... 242/131

4,163,357 8/1979 Greive et al. ..... 242/131.1

4,175,717 11/1979 Mathiolon ..... 242/131

4,240,594 12/1980 David ..... 242/131

4,363,225 12/1982 Marchisio ..... 66/125

4,464,891 8/1984 Manly ..... 242/131

*Primary Examiner*—Ronald Feldbaum

*Attorney, Agent, or Firm*—Guido Modiano Albert Josif

[57] ABSTRACT

This device for supporting cops in circular knitting machines, particularly in fixed needle cylinder knitting machines, comprises a plurality of frames which are arranged close together around the machine axis and carry the machine feed cops. Each frame is translatable parallel to itself along a direction having a substantially parallel component to the machine axis from a first raised working position to a second depressed position away from the machine axis to enable a floor-based operator to get at the cops of one frame when the latter occupies the second position; the device also comprises hooks for locking the frames in the first position.

13 Claims, 5 Drawing Figures

DEVICE FOR SUPPORTING COPS IN CIRCULAR KNITTING MACHINES, PARTICULARLY IN FIXED NEEDLE CYLINDER KNITTING MACHINES

BACKGROUND OF THE INVENTION

This invention relates to a device for supporting cops in a circular knitting machine, particularly in fixed needle cylinder knitting machines.

Known are devices for supporting cops in circular knitting machines, which comprise in general one or more frames associated above the machine to enable the several yarns to run down to the machine feeds.

Such devices are, especially in the instance of multi-feed large diameter machines, of considerable size and positioned at such an elevation as not to interfere with the machine parts at work and any operators busy near the machine.

This forces the operator in charge of cop doffing and checking to equip himself with a ladder or the like in order to reach the frame located upwardly of the machine.

In an attempt to solve this problem, vertically movable frames have been provided which can move far down from the working position and allow a floor-based operator to get easily at the cops.

Devices of this kind may comprise a single frame of substantially loop-like configuration which is allowed to slide along one or more upright guides, or a plurality of frames laid side-by-side around the machine axis and being allowed to slide individually along one or more upright guides fast with the machine structure.

These movable type devices, while being more efficient than the stationary types, have some problems.

In order to bring the cops down to the level of the machine outer skirt, it is, in fact, necessary to arrange for the inside diameter of the loop frame to be larger than the combined dimension of the skirt diameter plus the bulk of the devices associated therewith.

Where a plurality of frames are provided, likewise the cop holders must be placed far away from the machine axis.

This requirement leads to concentrating the device weight at a zone positioned at a greater distance from the machine axis than in case of devices fixedly arranged above the machine.

This fact interferes with the application of such devices to large diameter fixed cylinder machines, where, as is known, the cop holder device rotates together with the machine skirt.

Owing to the high rotational speeds attained by modern knitting machines, centrifugal forces are brought into play which, in that condition, would pose problems of strength and stability of the structure and of anchoring the cops thereto.

Furthermore, the presence of upright guides near the skirt would create problems of space due to the presence in that area of fixed control devices which interact with the skirt.

Lowering of the frame or frames, moreover, results with such prior designs in the yarn relaxing at the several feeds, which makes it necessary to adopt yarn tensioning devices to prevent the yarn from becoming entangled and later on, as the frame moves up or the machine is started, broken, bringing the machine to a standstill.

SUMMARY OF THE INVENTION

It is the primary aim of this invention to obviate such prior drawbacks by providing a cop holder device which has a smaller diameter while enabling the cops to be lowered externally of the machine skirt.

Within the above aim, it is an object of this invention to retain the yarn tensioning during the down movement and avoid the use of the yarn-tensioner devices.

Another object of the invention is to provide a device which allows lowering of even but some of the cops, e.g. the one of a feed, independently of the others.

This aim and these and other objects to become apparent hereinafter, are achieved by a device for supporting cops in circular knitting machines, particularly in fixed needle cylinder knitting machines, comprising a plurality of frame arranged close together around the machine axis and supporting the machine fed cops, characterized in that each said frame is translatable parallel to itself along a direction having a component substantially parallel to said axis and a component substantially perpendicular to said axis from a first raised working position to a second depressed position away from said axis, and vice versa, for said cop to be, in said second position, reached by a floor-based operator, controlled operation means being provided for locking said frames in said first position.

BRIEF DESCRIPTION OF THE DRAWINGS

Further features and advantages of the invention will be more clearly apparent from the following description of a preferred, though not exclusive, embodiment thereof, as shown by way of illustration and not of limitation in the accompanying drawings, where.

DESCRIPTION OF THE PREFERRED EMBODIMENTS

Figure 2:
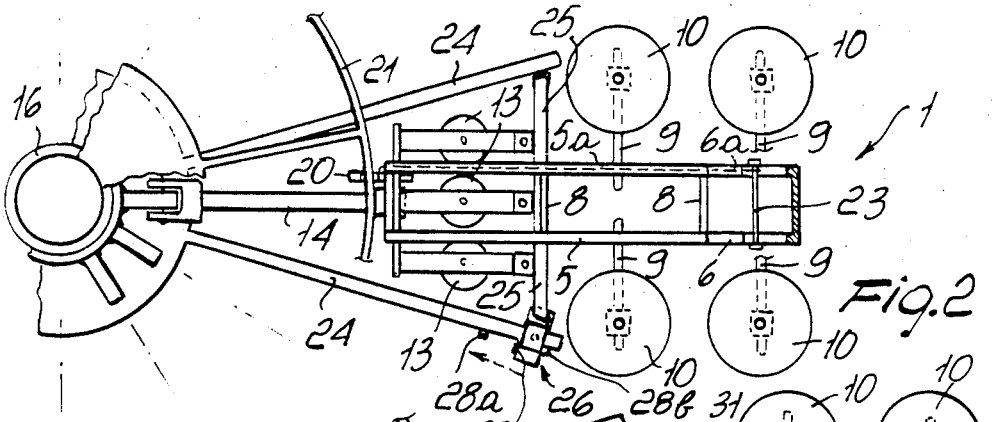
FIG. 2 is a top plan view of one of the frames, carrying the cops, in the first position.
Figure 3:
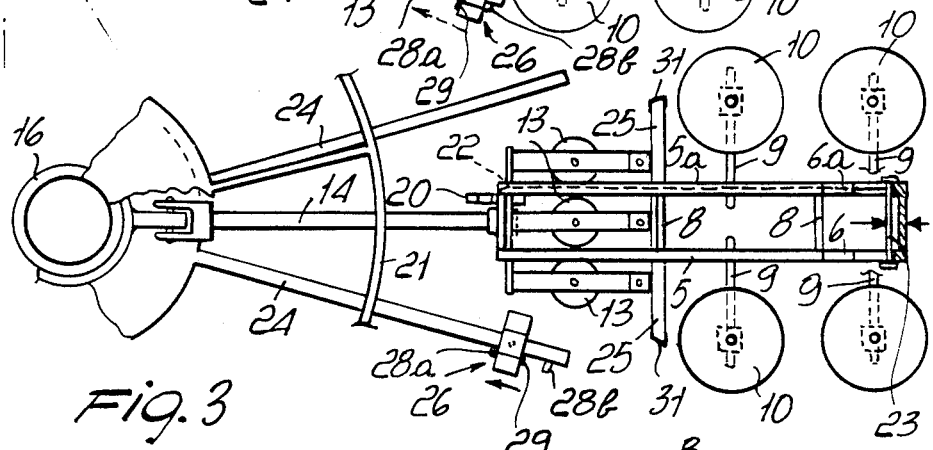
FIG. 3 is a top plan view of one of the frames, carrying the cops, in the second position.
Figure 1:
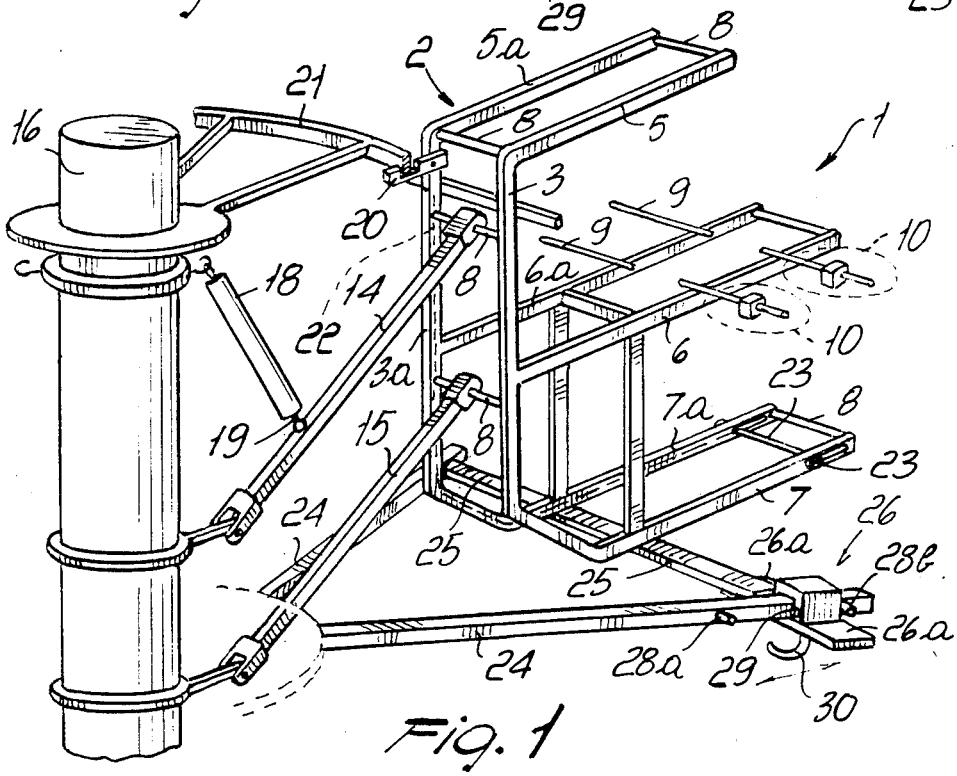
FIG. 1 is a perspective view of one of the frames of the inventive device.
Figure 4:
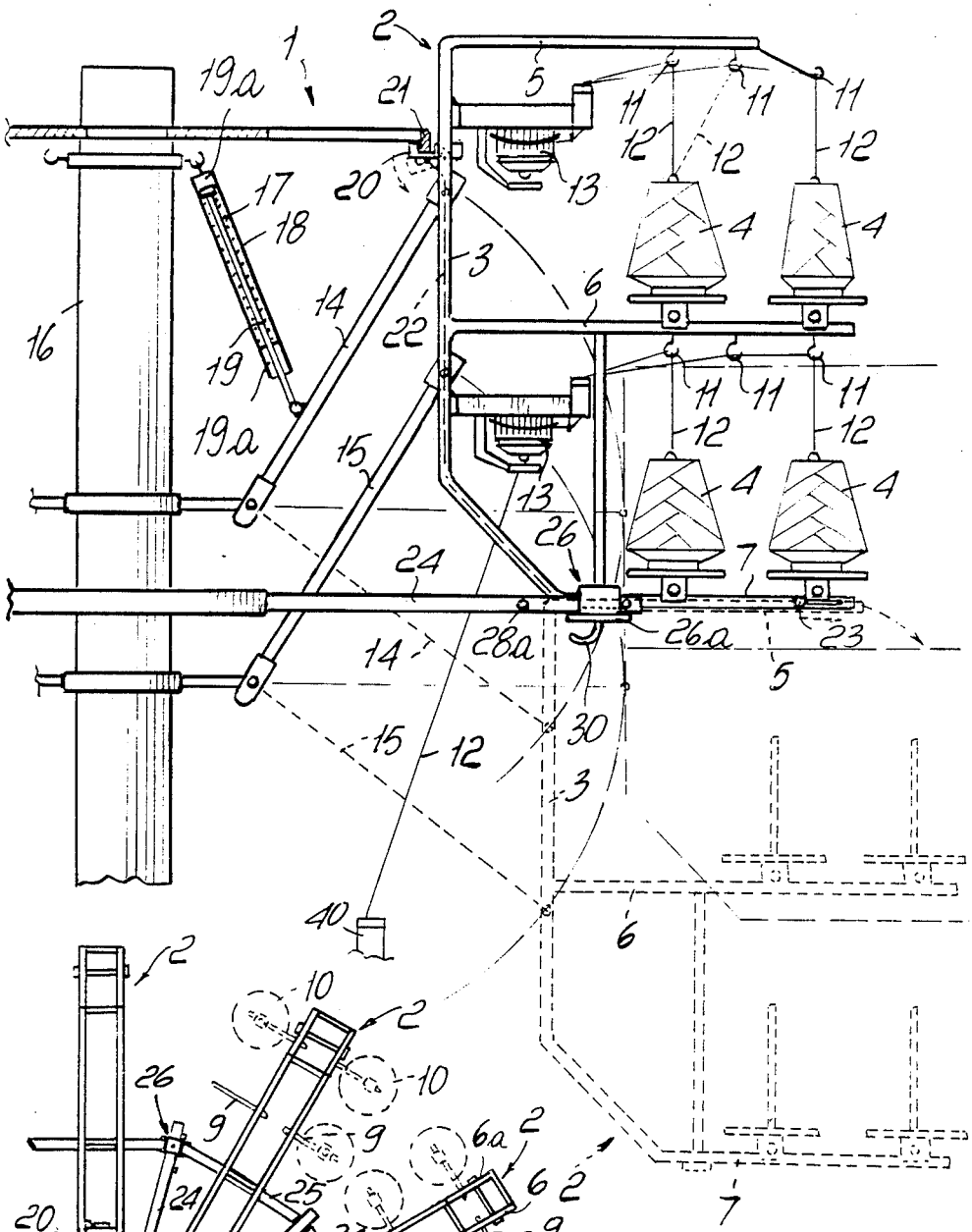
FIG. 4 is a side elevation view of one of the frames detailing the translation according to this invention.
Figure 5:
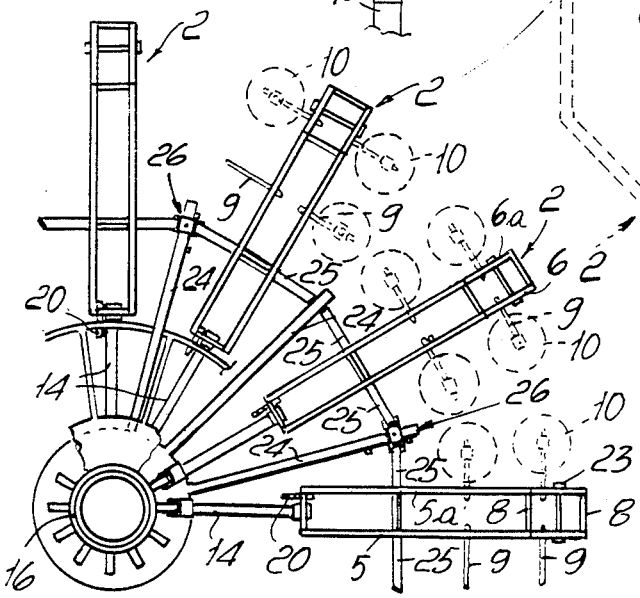
FIG. 5 is a top plan view of some of the plural frames of this invention.

With reference to the drawings, a device according to this invention, generally designated with the reference numeral 1, comprises a plurality of frames 2 arranged close together around the machine axis.

Each frame 2 comprises an upright portion defined by a pair of pillars 3,3*a* and one or more horizontal portions defined by crosspiece pairs which extend perpendicularly to the pillars to define supporting shelves for the cops 4. In the embodiment shown there are three pairs of crosspieces 5,5*a*,6,6*a*,7,7*a*, rspectively, which may be interconnected by stiffening elements generally designated with the reference numeral 8.

The crosspieces carry pins 9 whereover supporting disks 10 are slipped for the cops 4. The supporting disks 10 are associated with the pins 9 in a rotatable fashion but make a slightly forced fit to allow for the cops to be oriented and secured in a present position.

Furthermore, the frame 2 may present yarn leader hooks 11 which address the yarn 12 from the cops 4 to yarn magazines 13 which are carried, in turn, on the frame 2. Of course, each frame 2 may support all the devices belonging to the cops 4 and the yarn 12, which are mounted on present cop holding devices.

According to the invention, each of the frames 2 is translatable parallel to itself along a direction which has a parallel component to the machine axis and a perpendicular component to the machine axis.

In the embodiment shown, this translation is accomplished by means of two connecting rods 14 and 15, respectively, which have one end thereof hinged to two points on the frame 2 which are spaced apart vertically from each other. Said rods 14,15 extend parallel to each other and are hinged with the other end to two equally spaced apart points on a support shaft 16 which extends upwardly of the machine at the axis thereof.

In practice, the two connecting rods 14 and 15 constitute the parallel swingable sides of an articulated quadrilateral, the translating side whereof is indeed the frame 2.

The two connecting rods 14 and 15 are oscillable in a substantially vertical plane so as to bring the frame 2 from a first working position, raised above the machine, and a second depressed position away from the machine axis with respect to the first position.

To bear the frame 2 weight and favor the return movement of the frame to the first position, an elastic means is provided consisting essentially of a spring 17 which has one end associated with one of the connecting rods 14 and 15, in the illustrated instance the connecting rod 14, and the other end associated with the support shaft 16.

This spring may be also carried internally of a tubular body 18 removably connected with the shaft 16 and have one end engaged with a rod 19 slidable inside the tubular body 18 and hinged to the connecting rod 14. In this case, the spring 17 would extend between an end 19*a* of the tubular body 18 and an enlarged portion 17*a* of the rod 17 and be compressed as the frame is lowered.

According to the invention, the device 1 comprises means for locking the frame 2 in the first position, or working position, which means is actuatable on command.

This means comprises essentialy a hook 20 which is hinged to a portion of the frame 2, and precisely with the upright portion thereof, and is engageable with a stop rigid with the support shaft 16.

The stop may be represented by a portion of a ring 21 which is rigidly supported by the carrier shaft 16 coaxially on the exterior thereof. The hook 20 is operatively connected, such as by a steel wire 22, to an actuating handle 23 which is carried by a lower portion of the frame 2 so as to be within easy reach by a floor-base operator.

To achieve locking of the frame 2 sideways, a plurality of rods 24 is provided, which extend radially to the carrier shaft 16 and define, in the whole device, a plurality of sectors which are through-passed by the frames 2 during the movement of the later and engage laterally with opposing sides of the frames 2 in the raised position. More specifically, these rods 24 may be provided on the shaft 16 at a level which corresponds to a lower portion of the frame 2, with the latter in the raised position, whereas the lower portion of the frame 2 is provided with side projections 25 which engage between the two rods of the same sector.

Of course, it would be possible to provide a sector at every two frames; in this case, each frame would engage on one side with the neighbouring frame and on the other side with one of the rods 24.

Advantageously, there is also provided a safety means which cooperates with the hook 20 to lock the frame 2 in the first raised position. This safety means comprises a rest 26 which is slidingly carried on one of the rods 24 at the point of engagement with the side projections 25 of the frames 2. It would be possible to provide a rest 26 on each rod 24, or simpler still, a rest 26 at every two rods, since each rest 26 has two side extensions 26*a* which can support the side projections 25 of two adjoining frames at a time.

The rest 26 being slidable on the rod 24, it may be shifted therealong either so as to support the frame in the first raised position or not to interfere therewith so as to allow translation of the frame toward the second lowered position.

Advantageously, the rest 26 may be connected to the machine main drive so as to deactivate it on the rest 26 disengaging from the side projections 25 of the frames 2.

To that aim, the rest 26 carries a switch 29 which is connected in series with the main switch of the machine drive and can be activated and deactivated when brought into contact with an activation detent 28*a* and a disactivation detent 28*b*, respectively, which detents are fixedly provided on the rod 24.

For completeness of illustration, it should be said that downwardly of the rest 26 a peduncle or projecting portion 30 may be provided for facilitating its displacement by the operator.

Over the ends of the side projections 25 of the frames 2 elastic hoods 31 may be fitted to suppress any noise during the machine operation, especially with fixed needle cylinder knitting machines.

The mode of operation of the inventive device is self-evident from the foregoing description.

Assuming that the machine is in operation, the frames 2 are at the raised deposition, being locked there by the hooks 20 and carried on the rests 26 for safety reasons. To change one or more of the cops, the frames 2 which are involved in the change have to be lowered. To this aim, it will be sufficient, after stopping the machine, to radially pull the actuating handle 23 which, by pulling in turn on the steel wire 22, will rotate the hook 20 and disengage the same from ring 21.

At this point, the frame 2 cannot yet be lowered because the rest 26 is to be shifted first, thus introducing a further break in the power circuit to the machine drive. Thereafter, the frame or frames involved is/are lowered by hand, and the cop or cops 4 is/are changed. During the down movement, the yarns 12 which run down from the device toward the feeds 40 of the machine, owing to that simultaneously with the down movement there occurs a radial movement away from the machine axis, remain sufficiently tensioned to prevent the yarns 12 from rolling up even without yarn tensioning devices.

With the frame 2 down, there is no incidental likelihood of the machine starting because, even if the main switch is activated, the power supply circuit is held open by the switch 29.

On completion of the doffing operation, the frame 2 is raised, also by virtue of the action of the spring 17, and returned to the raised position hooked to the ring 21, by shifting the handle 23 in the rest position.

In order for the machine to be activated, it is necessary that the rest 26 be taken back under the side projections 25 of the frame 2, and this can only be accomplished if the frame 2 is properly hooked on.

It has been ascertained in actual practice that the device of this invention fully achieves its aim by affording positioning of the frames gathered around the machine axis in the raised working position and their down movement to get externally of the machine skirt. This fact is extremely important with fixed cylinder machines wherein the device turns with the skirt because in this way the centrifugal forces acting on the device and the cops during rotation can be held low.

A further advantage is that of having plural frames, each adapted for connection to a single feed of the machine such that a change of the cops for one feed would not disturb the unaffected feeds by the operation.

A not least advantage is that of obtaining a higly reliable and safe operation.

The device herein is susceptible to many modifications and variations, all of which fall within the scope of the inventive concept; furthermore, all the details may be replaced with technically equivalent elements.

The device, although particularly suitable on account of its features for use with fixed needle cylinder large-diameter machines, may be employed to advantage on rotating needle cylinder machines.

In practicing the invention, the materials used, as well as the dimensions, may be any ones contingent on requirements and the state of the art.

I claim:

1. A device for supporting cops in circular knitting machines, particularly in fixed needle cylinder knitting machines, comprising a bearing member defining a device central axis, a plurality of frames for supporting feed cops radially arranged around said bearing member, frame translation means connected to said bearing member and said frame for moving each said frame in a direction having a component substantially parallel to said device central axis and a component substantially perpendicular to said device central axis, said device further comprising controlled operation frame locking means for selectively and removably connecting said frame with said bearing member, thereby each said frame translating between a first raised working position, wherein said frame is arranged close to said bearing member and is locked by said frame locking means, and a second depressed cops doffing position, wherein said frame is arranged away from said bearing member, said device further comprising safety means including a plurality of rest portions and a plurality of delimiting rods extending radially from said bearing member and defining a plurality of sectors for laterally delimiting said frames, said frames having lateral cooperation means engaging with said delimiting rods, and being laterally locked on opposite sides at said first position, said rest portions being slidingly arranged on said delimiting rods and movable between a first interference point of said delimiting rods and a second noninterference point, said lateral cooperation means comprising lateral projections bearing on said rests in said first position of said frames with said rest at said first interference point.

2. A device according to claim 1, wherein said safety means further comprises knitting machine disactivating switching means connected to said rests, for switching between an opened and a closed condition with said rest at said first and second points.

3. A device according to claim 1 wherein said safety means further comprises knitting machine disactivating switching means connected to said rests for switching between an open and a closed condition with said rest portions at said second points, said switching means being adapted to be operated by displacing said rest portions with respect to said delimiting rods.

4. A device according to claim 2 wherein said switching means are adapted to be operated by radially displacing said rest portions with respect to said delimiting rods.

5. In combination, a circular knitting machine, and a device for supporting cops in said circular knitting machine, said device comprising defining a device central axis, a plurality of frames for supporting feed cops radially arranged around said bearing member, frame translation means connected to said bearing member and said frame for moving each said frame in a direction having a component substantially parallel to said device central axis and a component substantially perpendicular to said device central axis, said device further comprising controlled operation frame locking means for selectively and removably connecting said frame with said bearing member, thereby each said frame tarnslating between a first raised working position, wherein said frame is arranged close to said bearing member and is locked by said frame locking means, and a second depressed cops doffing position, wherein said frame is arranged away from said bearing member, said device further comprising a plurality of delimiting rods extending radially from said support shaft and defining a plurality of sectors for laterally delimiting said frames, said frames having lateral cooperation means engaging with said delimiting rods, and being laterally locked on opposite sides at said first position.

6. A combination according to claim 5 wherein said bearing member comprises a support shaft and wherein said controlled operation frame locking means comprises a plurality of hooks, each hook being hinged to one said frame, and a stop member rigid with said support shaft engaged by said hooks in said first position of said frames, each of said hooks being connected to an actuating handle, said actuating handle being positioned rear the bottom end of each said frame, said stop member being defined by a ring rigidly associated with said support shaft, and being arranged coaxially with respect thereto.

7. A combination according to claim 5 wherein said plurality of frames includes pairs of frames and wherein said plurality of delimiting rods comprises at least one delimiting rod for each pair of frames in said plurality of frames.

8. A combination according to claim 5 further comprising safety means including a plurality of rest portions slidingly arranged on said delimiting rods and movable between a first interference point of said delimiting rods and a second non-interference point.

9. A combination according to claim 8 wherein said lateral cooperation means comprises lateral projections bearing on said rest portions in said first position of said frames with said rest portions at said first interference point.

10. A combination according to claim 8 wherein said safety means further comprises knitting machine disactivating switching means connected to said rest portions, for switching between an opened and a closed condition with said rests at said first and second points.

11. A combination according to claim 8 wherein said safety means further comprises knitting machine disactivating switching means connected to said rest portions, for switching between an opened and a closed condition with said rests at said first and second points, said switching means being adopted to operated by radially displacing said rest portions with respect to said delimiting rods.

12. A combination according to claim 5 wherein said circular knitting machine comprises a machine skirt and wherein said machine skirt and said device for supporting cops in said circular knitting machine are adapted for codirectional rotational movement about said device central axis, said co-directional rotational movement of said machine skirt and said device generating a centrifugal force, said centrifugal force acting on said frames, said frame locking means being adapted for resisting said centrifugal force for retaining said frames close to said bearing member in said raised working position.

13. A combination according to claim 5 wherein said circular knitting machine is a fixed cylinder circular knitting machine having a machine skirt and wherein said machine skirt and said device for supporting cops are adopted for co-directional rotational movement about said device central axis.

* * * * *